US005938178A

United States Patent [19]

Oh

[11] Patent Number: 5,938,178

[45] Date of Patent: Aug. 17, 1999

[54] STAPLE REMOVER

[76] Inventor: Tae Gon Oh, 545 S. Manhattan Pl., No. 1, Los Angeles, Calif. 90020

[21] Appl. No.: 09/095,229

[22] Filed: Jun. 10, 1998

[51] Int. Cl.[6] ..... B25C 11/00

[52] U.S. Cl. ..... 254/28

[58] Field of Search ..... 254/28, 18, 22, 254/25; 7/161, 125, 166, 165, 901, 160

[56] References Cited

U.S. PATENT DOCUMENTS

| | | | |
|---|---|---|---|
| 2,662,727 | 12/1953 | Yerkes | 254/28 |
| 3,484,080 | 12/1969 | Tolliver | 254/28 |
| 3,974,999 | 8/1976 | Bertolet | 254/28 |
| 4,054,263 | 10/1977 | Delia | 254/28 |
| 4,513,951 | 4/1985 | Rogers | 254/28 |
| 4,553,737 | 11/1985 | Yi | 254/28 |
| 4,674,727 | 6/1987 | McAlister | 254/28 |
| 4,903,945 | 2/1990 | Wang | 254/28 |
| 4,921,216 | 5/1990 | Krulich | 254/28 |
| 4,944,491 | 7/1990 | Kirk | 254/28 |
| 5,085,404 | 2/1992 | Thieleke et al. | 254/18 |
| 5,090,662 | 2/1992 | Koo | 254/28 |
| 5,195,724 | 3/1993 | Koo | 254/28 |
| 5,284,322 | 2/1994 | Clark | 254/28 |
| 5,292,106 | 3/1994 | Li | 254/28 |
| 5,354,033 | 10/1994 | Cheldin | 254/28 |
| 5,513,833 | 5/1996 | Kirk | 254/28 |
| 5,605,320 | 2/1997 | Crawford | 254/28 |
| 5,657,965 | 8/1997 | Arias | 254/28 |

*Primary Examiner*—David A. Scherbel
*Assistant Examiner*—Lee Wilson

[57] ABSTRACT

A staple remover has first and second levers having a distal end and a proximal end, in which the distal ends of the first and second levers are pivotally connected for rotation about an axis. The second lever has parallel walls and a pair of teeth upwardly projecting from top of the proximal end wall. Each tooth comprises a front wall and gradually down-sloped back portion. The back portion of each tooth is gradually sloped downward to push the disengaged staples toward the distal end of the first lever. The staple remover also includes a spring strip mounted on an inner surface of the first lever and biased with a wire connected to the second lever. The spring strip is made with a flexible metal. One end of the wire is connected to the spring strip and the other end of the wire is connected to the second lever around a pin so that when the first and the second levers are in a closed position with respect to each other, the spring strip is biased toward the wedging elements of the first lever. When the first and the second levers are in an open position, the spring strip is retracted toward the distal end of the first lever and engages and pushes the staple toward the distal end of the first lever. The first lever has parallel walls in which there is a groove longitudinally formed on an outside surface of each wall so that there are matching grooves on outer surface of the walls. The grooves are used to hold disengaged staples.

17 Claims, 5 Drawing Sheets

STAPLE REMOVER

BACKGROUND OF THE INVENTION

1. Field of the Invention

This invention relates to a staple remover, and more particularly to a staple remover having a pair of parallely disposed teeth in a lever.

2. Description of Related Art

The staples have been around for many years and are utilized to secure papers or other materials in a manner that they are not easily detachable from each other. Sometimes, the staples must be removed and disengaged from the papers to separate them into individual pieces for purposes of copying or distributing. One such device which has been utilized to remove staples is a conventional staple remover which has a pair of levers pivotally connected at one end and spring biased such that the levers are held in an open position with their opposite ends away from one another. The levers of the staple remover have at their proximal ends, wedging elements in a form of two projections facing the opposite lever.

While various staple removers have been disclosed in the art, the removal of staples from an object such as a plurality of sheets of paper is not always easily accomplished. In order to work effectively, the wedging elements of the staple removers require the legs of the staple to be unbent and released almost simultaneously from the object. This sometimes require equal pressure to be applied on both levers of the staple remover. Unfortunately, sometimes staples may not be completely released from the paper by the conventional staple remover. For example, one leg of the staple may remain in the paper while the free leg slips out of the grasp of the staple remover. In such an event, the full removal of the staple usually requires manually bending, pulling and twisting on the staple with fingers.

In addition, the staples removed by the conventional staple remover usually do not remain thereon and are prone to falling from the staple remover and onto the floor or into copy machines. When the loose staples are picked up by moving parts of copy machines or vacuums cleaners, substantial and costly damage may result.

Moreover, when removing a plurality of staples from an object, the removed staples remaining on the lever of the staple remover sometime hinders the staple remover from operating correctly. As a result, the user must manual remove the staples from the staple remover making the task more cumbersome and time consuming.

SUMMARY OF THE DISCLOSURE

It is an object of the present invention to provide a staple remover which more securely grasps the staple during the removal process to help prevent leaving a staple or a portion thereof in a plurality of sheets of paper.

It is another object of the present invention to provide a staple remover for removing a staple from a plurality of sheets of paper so as to effectively pull both legs of the staples from the papers. It is another object of the present invention to retain the spent or disengaged staples in the staple remover until disposed of later.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

According to a preferred embodiment of the present invention, a staple remover fully removes a staple from an object, engages the staple into side grooves, moves the staple toward the back and collects the disengaged staples in the grooves until disposed of later. The staple remover comprises a first lever having a distal end and a proximal end and a second lever having a distal end and a proximal end. The distal ends of the first and second levers are pivotally connected for rotation about an axis. To pry the staple, there is a first wedging element extending from the proximal end of the first lever. Similarly, a second wedging element extends from the proximal end of the second lever. The first and the second wedging elements cooperate with each other to pry the staple.

In the preferred embodiment, there is at least one tooth, preferably two teeth, projecting from the proximal end of the second lever to cooperate with the first wedging element to pry the staple. In particular, the second lever has substantially parallel walls and each wall has a tooth which is upwardly projecting from the top of the wall. Each tooth comprises a front wall and a back portion. The front wall of each tooth upwardly projects from the top of the second lever wall to form an angle of about 95–100 degrees with respect to a longitudinal body of the second lever. Such construction allows the disengaged staple to be easily pulled over the teeth. The back portion of each tooth is gradually sloped downward to push the disengaged staples toward the distal end of the first lever.

As another aspect of the preferred embodiment, the staple remover further includes a spring strip mounted on a top inner surface of the first lever and biased with a wire connected to the second lever. The spring strip comprises a flexible strip, made with flexible metal or plastic. One end of the wire is connected to the spring strip and the other end of the wire is connected to the second lever around a pin so that when the first and the second levers are in a closed position with respect to each other, the spring strip is biased toward the wedging elements of the first lever. The spring strip is positioned with respect to the tooth so that when the first and the second levers are in the closed position, the spring strip is extended toward the wedging elements of the first lever to engage the staple when the staple remover opens. When the first and the second levers are in an open position, the spring strip is retracted toward the distal end of the first lever and simultaneously engages and pushes the staple toward the distal end of the first lever.

The spring strip comprises two segments forming substantially an L-shape body, a first segment of which is attached to the first lever and a second segment having a hook at the end for engaging the staple. The spring strip further comprises a loop formed on the second segment to connect the wire. The wire is made of any suitably resilient and non-elastic material, such as steel or plastic.

In the first lever which has substantially parallel walls, a groove is longitudinally formed on an outside surface of each wall so that there are matching grooves on outer surface of the walls. The depth of the groove is approximate one-half the thickness of the wall. A wall thickness of the groove is approximately 1 mm. Preferably, from the wedging elements to the end of the grooves of the first lever is magnetized to attract and hold the disengaged staples whether or not the legs of the staples are engaged in the grooves.

These and other aspects, features and advantages of the present invention will be better understood by studying the detailed description in conjunction with the drawings and the accompanying claims.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
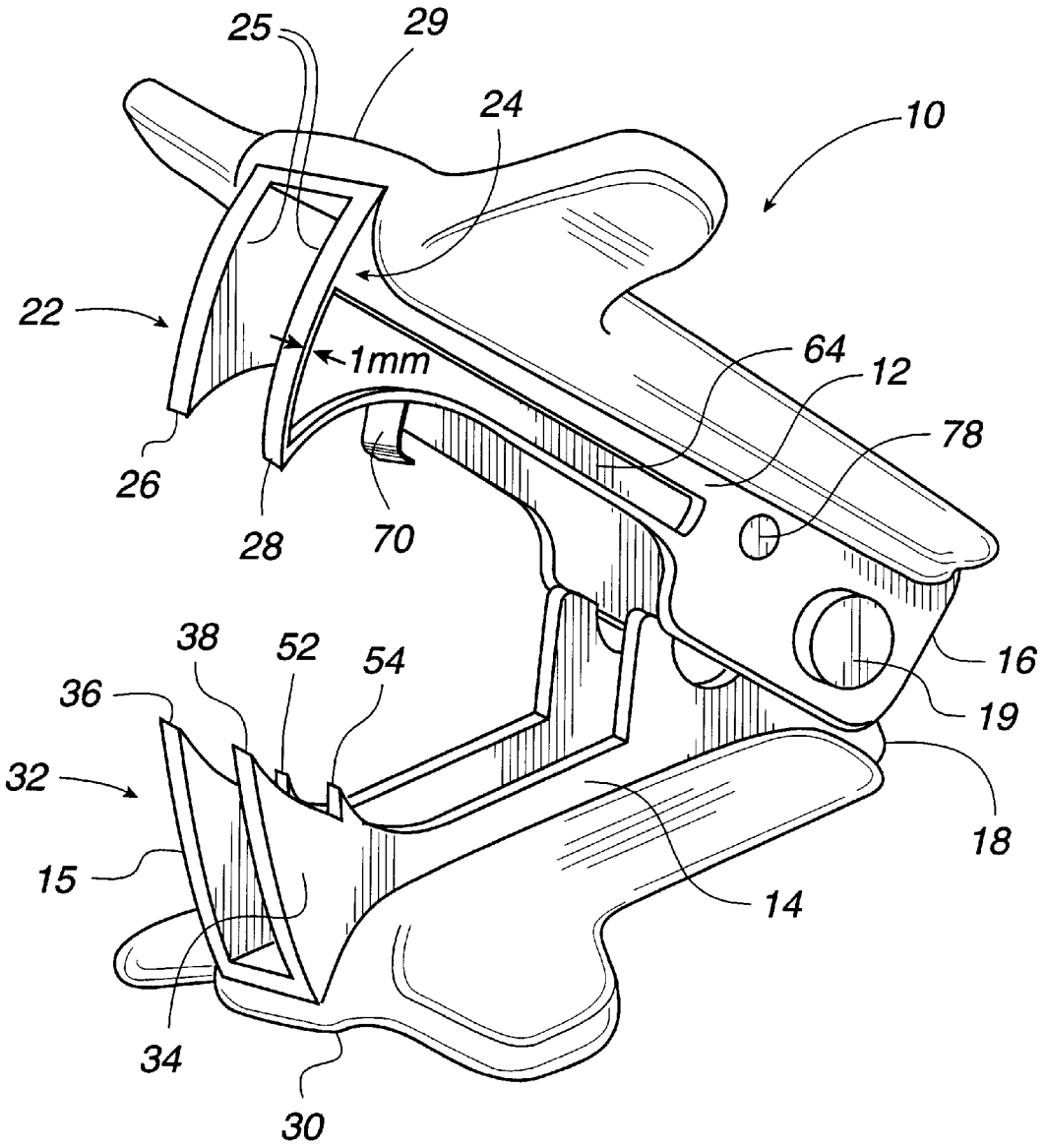
FIG. 1 illustrates a perspective view of a staple remover according to the present invention.

A staple remover 10 according to a preferred embodiment of the present invention is shown in FIGS. 1–11. Referring to FIG. 1, the staple remover 10 includes a larger channel-shaped first lever 12 and a smaller channel-shaped second lever 14. Each lever 12 and 14 includes respective distal end portions 16 and 18 which are pivotally connected by a pivot pin 19 for rotation towards one another about a single axis. A spring is provided inside the distal end portions 16 and 18, around the pivot pin 19, to bias the respective proximal ends 13 and 15 of the levers 12 and 14 away from each other into the open position shown in FIG. 1.

Figure 2:
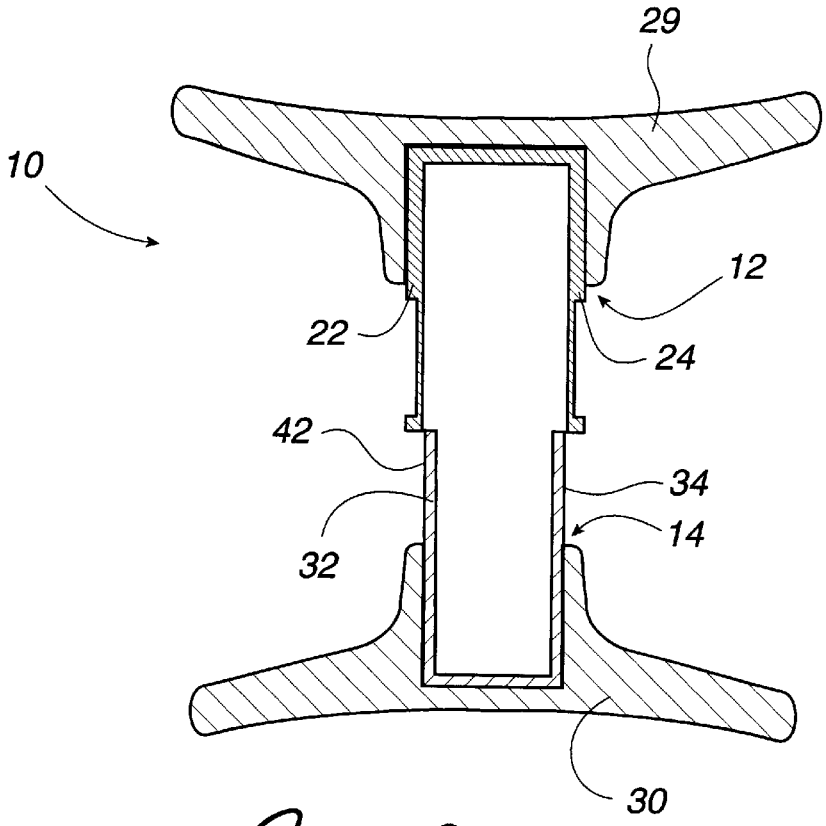
FIG. 2 illustrates a front plan view of the staple remover of FIG. 1.

Referring to FIGS. 1 and 2, the first lever 12 has a pair of spaced walls 22 and 24 which move in a plane perpendicular to the axis of rotation and which have wedging elements 26 and 28 at the proximal end. The second lever 14 has a pair of spaced apart walls 32 and 34 which also move in a plane perpendicular to the axis of rotation and which have wedging elements 36 and 38 at the proximal end thereof.

The distance between the second pair of walls 32 and 34 relative to the first pair of walls 22 and 24 is preferably such that, upon rotation of the first and the second levers 12 and 14 toward each other, the inner faces 25 of the walls 22 and 24 slidably engage the corresponding outer faces 42 of the walls 32 and 34, with the walls 32 and 34 being positioned between and overlapping with the walls 22 and 24 when the staple remover 10 is in a closed position. The first and the second levers 12 and 14 of the staple remover 10 are made with a suitably rigid and durable material, such as steel.

Each lever 12 and 14 includes plastic finger engaging member 29 and 30 attached respectively thereto. The finger engaging members 29 and 30 are pressed together by the fingers and thumb of the user to actuate the staple remover 10.

Figure 4:
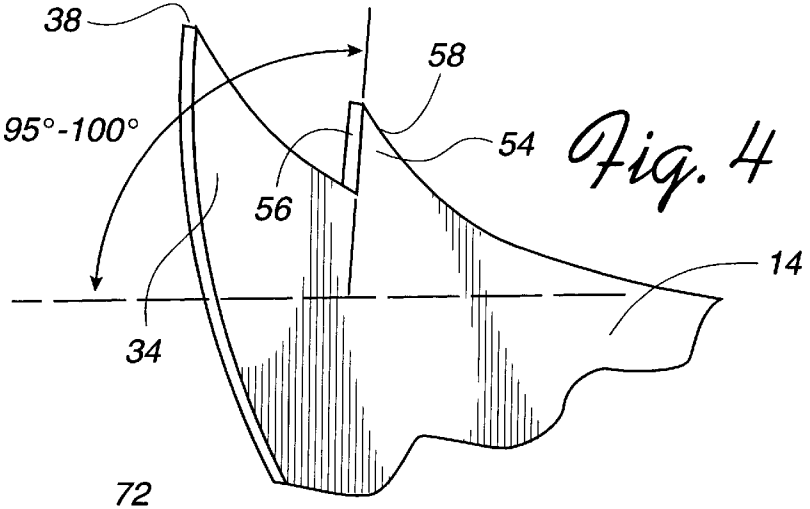
FIG. 4 illustrates a teeth portion of the second lever of the staple remover shown in FIG. 1.

As shown in FIGS. 1 and 4, the walls 32 and 34 of the second lever 14 have teeth 52 and 54 projecting from the top surface of the respective walls 32 and 34. In particular, the teeth 52 and 54 are located below the respective wedging elements 36 and 38. The teeth 52 and 54 are jointly used to firmly engage the staple in conjunction with the wedging elements 26 and 28 of the first lever 12. Because the staple is trapped between the wedging elements 26 and 28 of the first lever 12 and the teeth 52 and 54 of the second lever 14, the legs of the staple is simultaneously released from an object, thus enabling the staple to fully disengage the object. Even if one of the legs of the staple is unreleased from the object, the partially loose staple is tightly grasped between the first lever 12 and the teeth 52 and 54 of the second lever 14 and thus can be easily pulled away from the object without additional grasping or prying action. The teeth 52 and 54 act as a stopping hook to prevent the staple from sliding backwards, which has been the problem with convention staple removers.

FIG. 4 illustrates an enlarged view of one tooth 54 of the present invention. As described above, the tooth 54 is located substantially below the wedging element 38 of the second lever 14. Preferably, the angle of projection of the tooth 54 is approximately 95 to 100 degrees from the horizontal line formed by the second lever 14. It is preferred that the front wall 56 of the tooth 54 is straightly sloped from the wall 34 of the second lever 14. The downwardly sloped back portion 58 allows the disengaged staple to be pushed backward and readies the staple remover to remove other staples.

Figure 3:
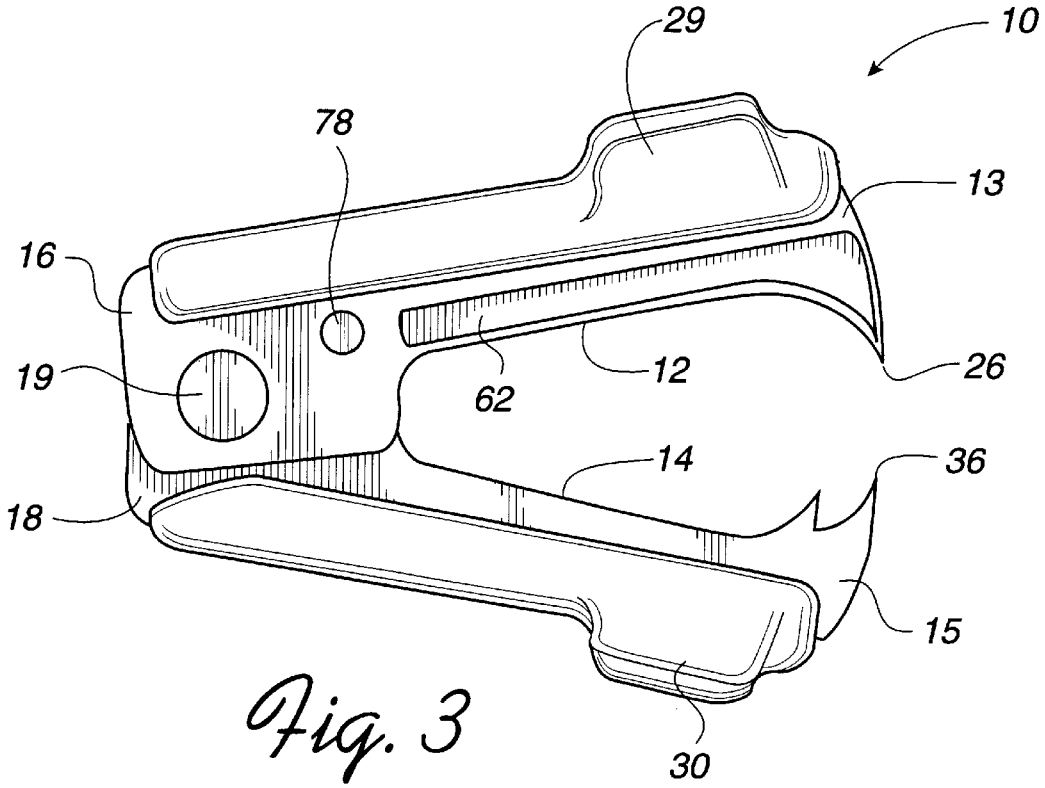
FIG. 3 illustrates a side plan view of the staple remover of FIG. 1.

As shown in FIGS. 1 and 3, each wall 22 and 24 of the first lever 12 includes respective grooves 62 and 64. The groove 64 begins near the wedging element 28 and ends near the distal end 16 of the first lever 12. Each groove 62 and 64 extends longitudinally along the lateral side of the first lever 12 as shown in FIG. 1. A typical wall thickness of the staple remover 10 is about 1.4 mm. As such, the depth of the groove 64 is preferably about one-half of the wall thickness or about 0.7 mm. The groove 64 begins about 1 mm laterally from the front of the first lever 12.

Similarly, the groove 62 is formed in the wall 22 opposite to the groove 64. Both the grooves 62 and 64 are identically configured, and thus, the description will not be repeated for the sake of brevity.

To prevent the disengaged staples from dropping to the floor, it is preferable that the first lever 12 is made of a magnetized material to allow the staples to cling thereto. It is also preferable that instead of making the entire first lever 12 with a magnetic material, only the grooves 62 and 64 can be magnetized.

Figure 5:
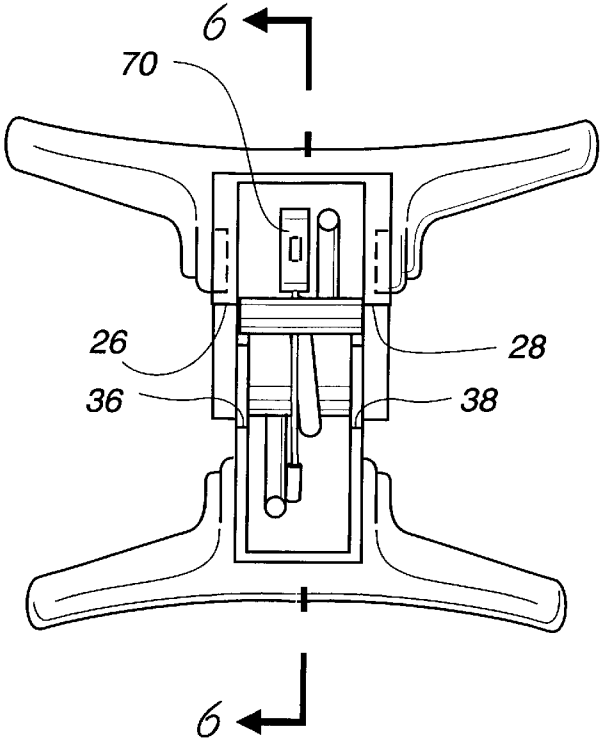
FIG. 5 illustrates a front internal view of FIG. 1.

FIG. 5 shows a front internal view of the staple remover 10. FIG. 5 also shows the interaction and construction of the first lever 12 and the second lever 14.

Figure 6:
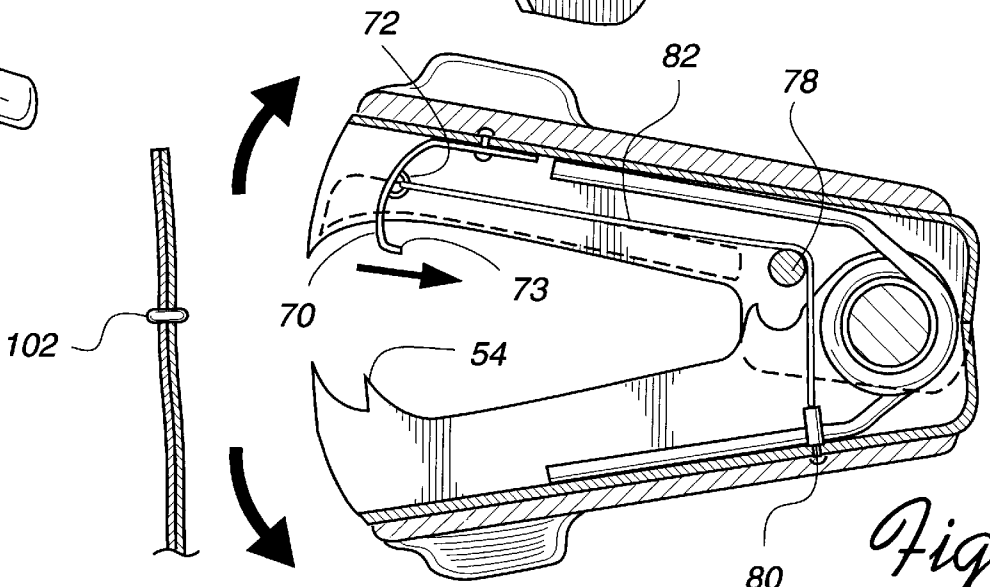
FIG. 6 illustrates a cross-sectional view of the staple remover along line 6 shown in FIG. 5 ready to engage a staple.

As shown in FIGS. 1 and 6, the staple remover 10 according to the preferred embodiment has a spring strip 70, the movement of which is controlled by the closing and opening action of the first and the second levers 12 and 14. The spring strip 70 has substantially an L-shape, one segment of which is attached to the top inner surface of the first lever 12. The other segment has a slightly bent hook 73 for engaging the disengaged staple. Preferably, the same fastener which fastens the finger engaging member 29 also fastens the spring strip 70 in place. Alternatively, the spring strip 70 may be attached to the first lever 12 using any suitable method, such as adhesive or solder. On the loose end of the spring strip 70, there is a loop 72 rearwardly protruding out of the spring strip 70 for engaging a wire 82 which actuates the movement of the spring strip 70. Preferably, the loop 72 is made by puncturing a thin strip in the middle of the spring strip 70 and bending the thin strip in a loop form.

The spring strip 70 is preferably located so that when the staple remover 10 is fully closed, the spring strip 70 opens toward the wedging elements 26 and 28 of the first lever 12 and is hidden from the passage way of the staple on the first lever 12 in order to allow the disengaged staple to be fully coupled to the teeth 52 and 54 of the second lever 14. When the staple remover 10 is opened, the spring strip 70 sufficiently retracts toward the distal end of the first lever 12 pass the teeth 52 and 54 of the second lever 14. The length of the wire 82 can be adjusted to control the extension and retraction of the spring strip 70.

The wire 82 is preferably made with a non-elastic and durable wire made with any suitable material, such as steel. A common piano wire is also suitable. One end of the wire 82 is connected to the loop 72 of the spring strip 70 and the other end is connected to a terminal 80, through a pin 78 which is extending across the inner surface of the distal end 18 of the second lever 14 in parallel with the pivot pin 19. The pin 78 axially connects two walls 22 and 24 of the first lever 12. Instead of using the terminal 80, one end of the wire 82 may be affixed to the second lever 14 using any suitable method.

Figure 7:
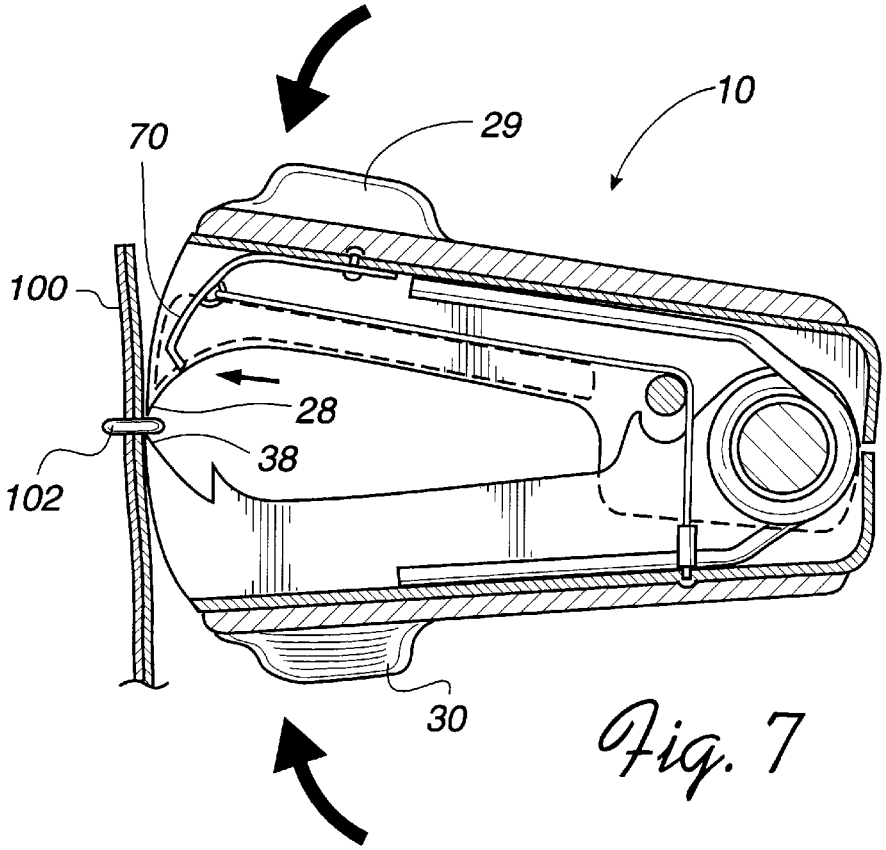
FIG. 7 illustrates a cross-sectional view of the staple remover engaging a staple from an object.

The operation of the staple remover 10 according to the present invention is discussed in connection with FIGS. 7 to 10. FIG. 7 illustrates a cross-sectional view of the staple remover 10 engaging a staple 102 from an object 100, such as a plural sheets of paper. As shown, the wedging elements 26 and 28 of the first lever 12 and the wedging elements 36 and 38 of the second lever 14 are respectively placed on the top and bottom of the staple 102 by depressing the finger engaging members 29 and 30 as shown by two opposite arrows. When depressed, the spring strip 70, as a result of its spring biased condition, moves toward the wedging elements 26 and 28, as shown by the arrow, and is preferably hidden inside the walls 22 and 24 of the first lever 12.

Figure 8:
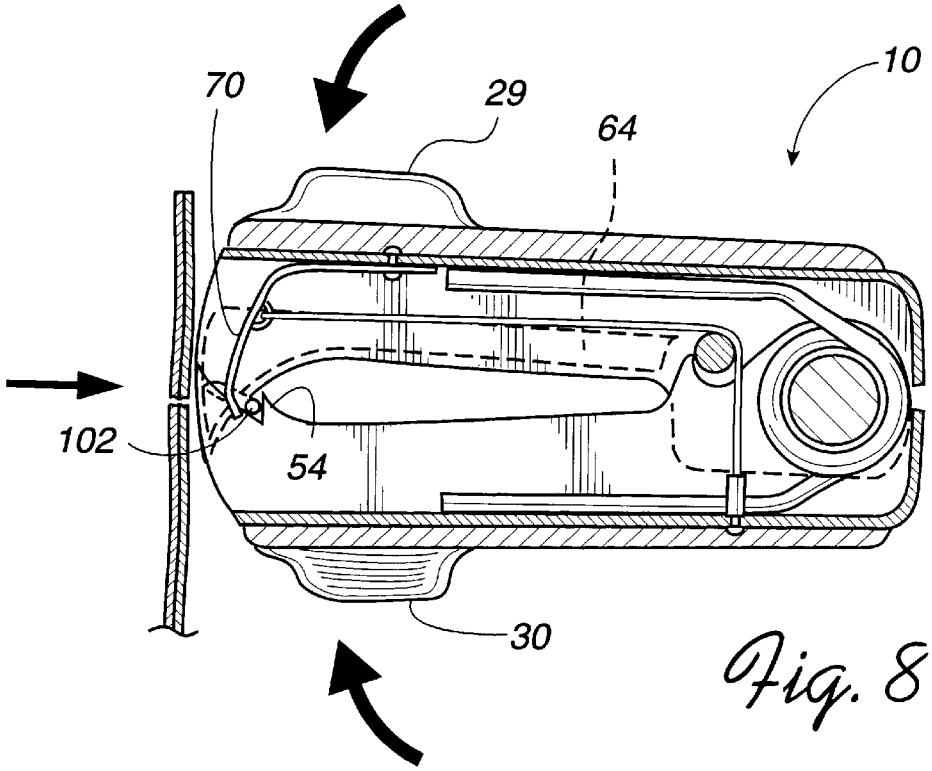
FIG. 8 illustrates a cross-sectional view of the staple remover removing the staple.

The next step is shown in FIG. 8, which is a cross-sectional view of the staple remover 10 removing the staple 102. When the finger engaging members 29 and 30 of the staple remover 10 are further depressed, the staple 102 is wedged between the wedging elements 26 and 28 of the first lever 12 and the teeth 52 and 54 of the second lever 14, thus firmly holding the staple 102. As a result, the legs of the staple 102 are fully disengaged from the object 100 and are placed in the corresponding grooves 62 and 64 of the first lever 12. At this point, the spring strip 70 is fully extended and is hidden inside the walls 22 and 24 of the first lever 12.

Figure 9:
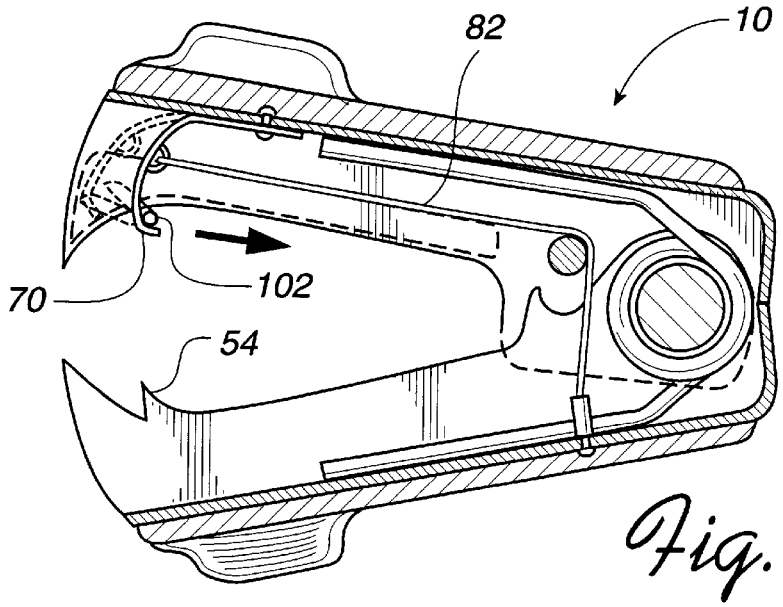
FIG. 9 illustrates a cross-sectional view of the staple remover retracting the disengaged staple toward a back portion of the teeth.

As shown in FIG. 9, when the staple 102 is fully disengaged from the object 100, the staple remover 10 is allowed to open due to the inner spring biasing the first and second levers 12 and 14 to an open position. As the first and second levers 12 and 14 open with respect to each other, the downward movement of the second lever 14 pulls the wire 82 which in turn pulls the spring strip 70 to engage the staple 102 and pull it slightly backwards so that the disengaged staple 102 is placed behind the teeth 52 and 54.

Figure 10:
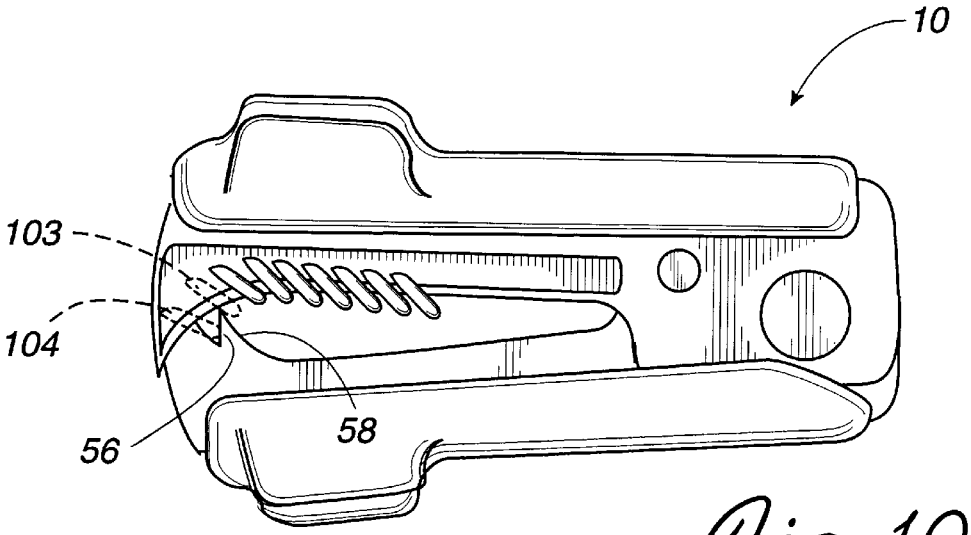
FIG. 10 illustrates a side plan view of the staple remover showing disengaged staples in the side grooves.

FIG. 10 illustrates a side plan view of the staple remover 10 showing disengaged staples in the side grooves 62 and 64. When the staple remover 10 is fully closed with a first staple 103 between the first and second levers 12 and 14, the first staple legs are completely disengaged from the object and engage the grooves 62 and 64. Even if the legs of the first staple 103 are not completely in the grooves 62 and 64, the magnetic characteristic of the grooves 62 and 64 retains the first staple 103. When the staple remover 10 is opened, the spring strip 70 pulls the disengaged first staple 103 toward the back approximately 2 mm so that the first staple 103 is positioned behind the teeth 52 and 54 with both legs engaged in the grooves 62 and 64, as shown in FIG. 9. When the staple remover 10 is depressed again to remove a second staple 104, the respective back portions 58 of the teeth 52 and 54, which gradually slopes downward, further moves the disengaged first staple 103 toward the back while the first lever 12 and the teeth 52 and 54 are engaging the second staple 104. In other words, the first staple 103 is positioned against the back portions 58 and the second staple 104 is positioned against the front walls 56 of the teeth 52 and 54.

Figure 11:
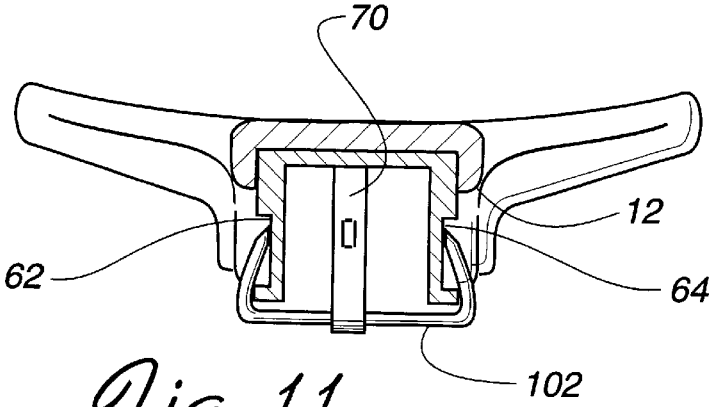
FIG. 11 illustrates a cross-sectional view of the staple remover showing the position of the staple in the first lever.

FIG. 11 illustrates a cross-sectional view of the staple remover 10. As shown, the spring strip 70 engages the disengaged staple 102 and rearwardly moves approximately 2 mm to give the teeth 52 and 54 a clean path for the first lever 12 to engage another staple. In addition, the legs of the disengaged staple 102 are placed in the corresponding grooves 62 of 64.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A staple remover for removing a staple, the staple remover comprising:

a first lever having a distal end and a proximal end;

a second lever having a distal end and a proximal end, wherein the distal ends of the first and second levers are pivotally connected for rotation about an axis;

a first wedging element extending from the proximal end of the first lever;

a second wedging element extending from the proximal end of the second lever, wherein the first and the second wedging elements cooperate with each other to pry the staple;

at least one tooth projecting from the proximal end of the second lever to cooperate with the first wedging element to pry the staple; and a spring strip mounted on an inner surface of the first lever and biased with a wire connected to the second lever.

2. A staple remover of claim 1, the second lever having substantially parallel walls, wherein each wall has a tooth which is upwardly projecting from the wall of the second lever.

3. A staple remover of claim 2, each tooth comprises a front wall and back portion, wherein the front wall upwardly projects from the wall to form an angle of about 95–100 degrees with respect to a longitudinal body of the second lever.

4. A staple remover of claim 3, wherein the back portion of the tooth is gradually sloped downward for pushing the staple toward the distal end of the first lever.

5. A staple remover of claim 1, wherein the spring strip comprises a flexible strip and one end of the wire is connected to the spring strip and the other end of the wire is connected to the second lever around a pin so that when the first and the second levers are in a closed position with respect to each other, the spring strip is biased toward the wedging elements of the first lever.

6. A staple remover of claim 5, wherein the spring strip is positioned with respect to the tooth so that when the first and the second levers are in the closed position, the spring strip is extended toward the wedging elements of the first lever to engage the staple, and when the first and the second levers are in an open position, the spring strip is retracted toward the distal end of the first lever and engages and pushes the staple toward the distal end of the first lever.

7. A staple remover of claim 1, wherein the spring strip comprises two segments forming substantially an L-shape body, a first segment being attached to the first lever and a second segment having a hook at the end for engaging the staple.

8. A staple remover of claim 7, the spring strip further comprising a loop formed on the second segment to connect the wire.

9. A staple remover of claim 1, wherein the spring strip is positioned with respect to the tooth so that when the first and the second levers are in the closed position, the spring strip is extended toward the wedging elements of the first lever to engage the staple, and when the first and the second levers are in an open position, the spring strip is retracted toward the distal end of the first lever and engages and pushes the staple toward the distal end of the first lever.

10. A staple remover for removing a staple, the staple remover comprising:

a first lever having a distal end and a proximal end, the first lever having substantially parallel walls and a groove longitudinally formed on an outside surface of each wall, wherein the depth of the groove is approximate one-half the thickness of the wall;

a second lever having a distal end and a proximal end, wherein the distal ends of the first and second levers are pivotally connected for rotation about an axis;

a first wedging element extending from the proximal end of the first lever;

a second wedging element extending from the proximal end of the second lever, wherein the first and the second wedging elements cooperate with each other to pry the staple;

at least one tooth projecting from the proximal end of the second lever to cooperate with the first wedging element to pry the staple.

11. A staple remover of claim 10, wherein a wall thickness of the groove is approximately 1 mm.

12. A staple remover of claim 10, wherein the groove is magnetized to attract and hold the staple.

13. A staple remover comprising a first lever having a distal end and a proximal end;

a second lever having a distal end and a proximal end, wherein the distal ends of the first and second levers are pivotally connected for rotation about an axis, the second lever having substantially parallel walls, each wall having a tooth projecting from the wall near the proximal end of the second lever, each tooth having a front wall and a back wall, wherein the front wall upwardly projects from the wall to form an angle of about 95–100 degrees with respect to a longitudinal body of the second lever, and the back wall forms a declining slope surface to push a removed staple toward rear of the lever when the first and second levers are depressed toward each other;

a first wedging element extending from the proximal end of the first lever; and a second wedging element extending from the proximal end of the second lever, wherein the first and the second wedging elements cooperate with each other to pry a staple;

a projecting part extending from the first lever to move the staple blocked by the front walls of corresponding teeth to the back wall of the teeth; and a wire connected to the projecting part, wherein the projecting part comprises a flexible strip and one end of the wire is connected to the projecting part and the other end of the wire is connected to the second lever around a pin so that when the first and the second levers are in a closed position with respect to each other, the projecting part is biased toward the wedging elements of the first lever.

14. A staple remover of claim 13, wherein the projecting part is positioned with respect to the tooth so that when the first and the second levers are in the closed position, the projecting part is extended toward the wedging elements of the first lever to engage the staple, and when the first and the second levers are in an open position, the projecting part is retracted toward the distal end of the first lever and engages and pushes the staple toward the distal end of the first lever.

15. A staple remover of claim 13, the first lever having substantially parallel walls, wherein a groove is longitudinally formed on an outside surface of each wall.

16. A staple remover of claim 13, wherein the groove is magnetized to attract and hold the removed staple.

17. A staple remover comprising:

a first lever having a distal end and a proximal end;

a second lever having a distal end and a proximal end, wherein the distal ends of the first and second levers are pivotally connected for rotation about an axis, the second lever having substantially parallel walls, each wall having a tooth projecting from the wall near the proximal end of the second lever, each tooth having a front wall and a back wall, wherein the front wall upwardly projects from the wall to form an angle of about 95–100 degrees with respect to a longitudinal body of the second lever, and the back wall forms a declining slope surface to push a removed staple toward rear of the first lever when the first and second levers are depressed toward each other; and a first wedging element extending from the proximal end of the first lever; and a second wedging element extending from the proximal end of the second lever, wherein the first and the second wedging elements cooperate with each other to pry a staple;

a projecting part extending from the first lever to move the staple blocked by the front walls of corresponding teeth to the back wall of the teeth, wherein the projecting part comprises two segments forming substantially an L-shape body, a first segment being attached to the first lever and a second segment having a hook at the end for engaging the staple.

* * * * *